US006495238B1

(12) United States Patent
Campbell

(10) Patent No.: US 6,495,238 B1
(45) **Date of Patent: *Dec. 17, 2002**

(54) BANNER MATERIAL WITH DOUBLE GROMMETS

(75) Inventor: William Paul Campbell, Puslinch (CA)

(73) Assignee: Cambridge Canvas Centre Ltd., Cambridge (CA)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/112,331

(22) Filed: Jul. 9, 1998

(51) Int. Cl.[7] ..... G90F 7/00

(52) U.S. Cl. ..... 428/121; 40/604; 114/219; 116/173; 116/174; 428/66.6; 428/81; 428/124; 428/138

(58) Field of Search ..... 428/66.6, 81, 121, 428/124, 131; 40/604; 116/173, 174; 156/248, 252, 253; 114/219

(56) References Cited

U.S. PATENT DOCUMENTS

| | | | | |
|---|---|---|---|---|
| 2,655,749 A | | 10/1953 | La Fontaine | 40/125 |
| 2,764,830 A | | 10/1956 | Frey | 40/125 |
| 3,089,268 A | | 5/1963 | Frey et al. | 40/128 |
| 4,653,419 A | * | 3/1987 | Brandon | 114/219 |
| 4,906,503 A | | 3/1990 | De La Cruz et al. | 428/81 |
| 4,909,884 A | * | 3/1990 | Wormser | 156/248 |
| 5,522,165 A | | 6/1996 | Molla | 40/604 |
| 5,899,010 A | * | 5/1999 | Peck | 40/618 |

FOREIGN PATENT DOCUMENTS

| | | | |
|---|---|---|---|
| DE | 4311753 A1 | * | 10/1994 |
| GB | 22512330 | * | 7/1992 |

* cited by examiner

*Primary Examiner*—Nasser Ahmad
(74) *Attorney, Agent, or Firm*—R. Craig Armstrong; Borden Ladner Gervais LLP

(57) ABSTRACT

The banner material is comprised of flexible polyester fabric which comes in a rolled elongated sheet. A number of grommets are placed along the top and bottom edges. The grommets along the top edge are aligned with the grommets along the bottom edge and are placed along the top and bottom edges of the banner material alternately a first distance apart and a second substantially smaller distance apart. The user of the banner can customize the length of the banner by cutting from top edge to bottom edge between the grommets, preferably between the grommets spaced the second substantially smaller distance apart in order to avoid wasting any excess banner material.

10 Claims, 3 Drawing Sheets

BANNER MATERIAL WITH DOUBLE GROMMETS

BACKGROUND OF THE INVENTION

1. Field of the Invention

This invention relates to flexible banner material having grommets placed along its top and bottom edges such that the size of the banner can be customized without wasting excess banner material.

2. Description of the Prior Art

Banners used to display advertising or other information are typically placed in conspicuous outdoor locations so that they can be easily viewed. They must be held tautly in place so that the information on the banner is not obscured by folding or creasing. In order to ensure that the banner material is held tautly in place while at the same time ensuring that the banner does not sustain damage as a result of wind forces or other elements, they are typically made of flexible fabric or sheet like material and are typically supported in their display position by flexible means such as cords, ropes or wires.

The prior art reveals various features and methods used to hang banners. One type of banner has the top and bottom edges of the banner being folded over and stitched to form a seam along the entire top and bottom edges. A rope or cord is inserted through each of the top and bottom seams. The ropes or cords are secured to fixed points adjacent to the banner and the banner is hung by suspending it between the two ropes. This method of securing the banner is deficient because ropes and cords tend to stretch with time, causing slack in the rope and the banner to eventually wrinkle and crease thus obscuring the information on the banner. Also, as the rope or cord becomes slack, wind may whip the banner back and forth causing weakening of the banner fabric itself and thus tearing of the seams through which the ropes are inserted.

Another method for hanging banners involves having rings or grommets in each corner of the banner. A cord is attached to each corner ring or grommet. Each of these cords is then tightened and secured to a fixed point, thus securing the banner in place. A significant problem with these type of banners is that these banners are typically manufactured and sold to the consumer at a predetermined size. This allows the consumer to choose from a selection of predetermined banner sizes, choosing the size that fits his or her need. With this type of banner, the consumer, however, cannot himself or herself customize the exact size of the banner.

Banner material is also sold in rolls of substantial length so that the consumer can customize the length of the banner himself or herself. The problem with existing banner material sold in rolls is that grommets are spaced along the top and bottom edges at a substantial distance from each other, thus causing significant waste of material. As mentioned above, a common method of hanging a banner properly, requires a grommet in each banner corner. To create a banner from a roll of banner material, the consumer will cut the banner material from top edge to bottom edge adjacent to aligned grommets. This creates 2 grommeted corners and two non grommeted corners. The banner material extending from the non grommeted corners to the next set of grommets is wasted, since it has no grommets at two of its corners.

Another problem associated with the use of grommets as a securing means is that grommets tend to tear out of the corners when the banner is subjected to forces caused by wind or other elements. The prior art reveals attempted solutions to the problem of grommets tending to tear out of the corners of the banner. One such attempted solution discloses banners which have folded over, hemmed top and bottom edges. The grommets are inserted within the folded over portion. The hems are designed to provide extra support for grommets so that they do not tear off the banner. Often, however, the hems are not sufficiently strong to avoid grommets tearing due to forces generated by strong winds and other turbulence.

U.S. Pat. No. 5,522,165 (Molla) provides another attempted solution to the problem of tearing grommets. The Molla patent discloses a banner of predetermined rectangular shape having four corners, with hems along the top and bottom edges. Grommets are placed in each corner. Resilient shock absorbing cords such as bungee cords are secured to each corner grommet. A rigid plastic piece is enveloped in each corner of the banner, surrounding the grommets, as extra support for the grommets. The plastic piece does provide additional support for the grommets, however, if banner material is stored in a roll, the rigid pieces may impede proper rolling of the banner material.

SUMMARY OF THE INVENTION

It is an object of the invention to allow the end user of the banner to create a banner of customized size from a roll of banner material, without wasting excess banner material.

It is a further object, in the preferred embodiment of the invention, to improve on the prior art by providing banner material having grommets which are secured in place by such means that prevent them from being torn by forces associated with wind and other elements.

In the preferred embodiment of the invention, banner material is comprised of flexible polyester fabric which comes in an elongated sheet, the preferred length of which is 45 feet, on a roll. The grommets are placed along the entire length of the top and bottom edges of the banner material alternately a first distance apart, preferably 24 inches, and a second substantially smaller distance apart, preferably 3 inches. These distances may vary. For example, the first distance apart may be as little as 12 inches, which would allow the consumer more ability to customize the exact size of the banner. The first distance may also be greater in order to conserve the number of grommets used. Likewise, the second smaller distance could be as much as 6 inches in order to conserve the number of grommets or as little as 1 inch to minimize wasted banner material. The grommets along the top edge are aligned with the grommets along the bottom edge. The user of the banner can customize the length of the banner by cutting from top edge to bottom edge between the grommets, creating grommeted corners. Preferably, the user will cut from top edge to bottom edge between the grommets spaced the smaller distance apart, creating banner corners without wasting any banner material. A cord or rope, preferably being somewhat elastic is inserted and secured through grommets located at each corner of the banner and each cord is tightly secured to a fixed position so that the banner can be hung.

In the preferred embodiment, along the top edge and the bottom edge of the material, a portion of the sheet is folded over to form an edgefold. The folded over portion is heated and pressed together, sealing the folded portion, creating a strong thermal heat sealed bond. Preferably, the edgefold is approximately 1.5 inches wide, running along the entire top and bottom edges of the banner material. The grommets, are placed within the top and bottom edgefolds. Placing the grommets in the thermal heat sealed edgefold provides reinforcement and strength to ensure that the grommets will not rip out of the banner material once tied to the rope or cord and the banner is subject to strong wind forces or other turbulence. The thermal heat seal creates a fixed bond over the entire folded over portion. As such, the thermal heat sealed edgefold is significantly stronger a bond than the other securing means such as a hemmed edgefold, since the hemmed edgefold is only secured along the hemline.

The preferred distances between the top edge and bottom edge of the banner material is either 22 inches, 34 inches or 44 inches, however the actual distance may range anywhere from 20 to 50 inches.

Further features of the invention will be described or will become apparent in the course of the following detailed description.

BRIEF DESCRIPTION OF THE DRAWINGS

In order that the invention may be more clearly understood, the preferred embodiment thereof will now be described in detail by way of example, with reference to the accompanying drawings, in which.

DETAILED DESCRIPTION OF THE PREFERRED EMBODIMENT

Figure 1:
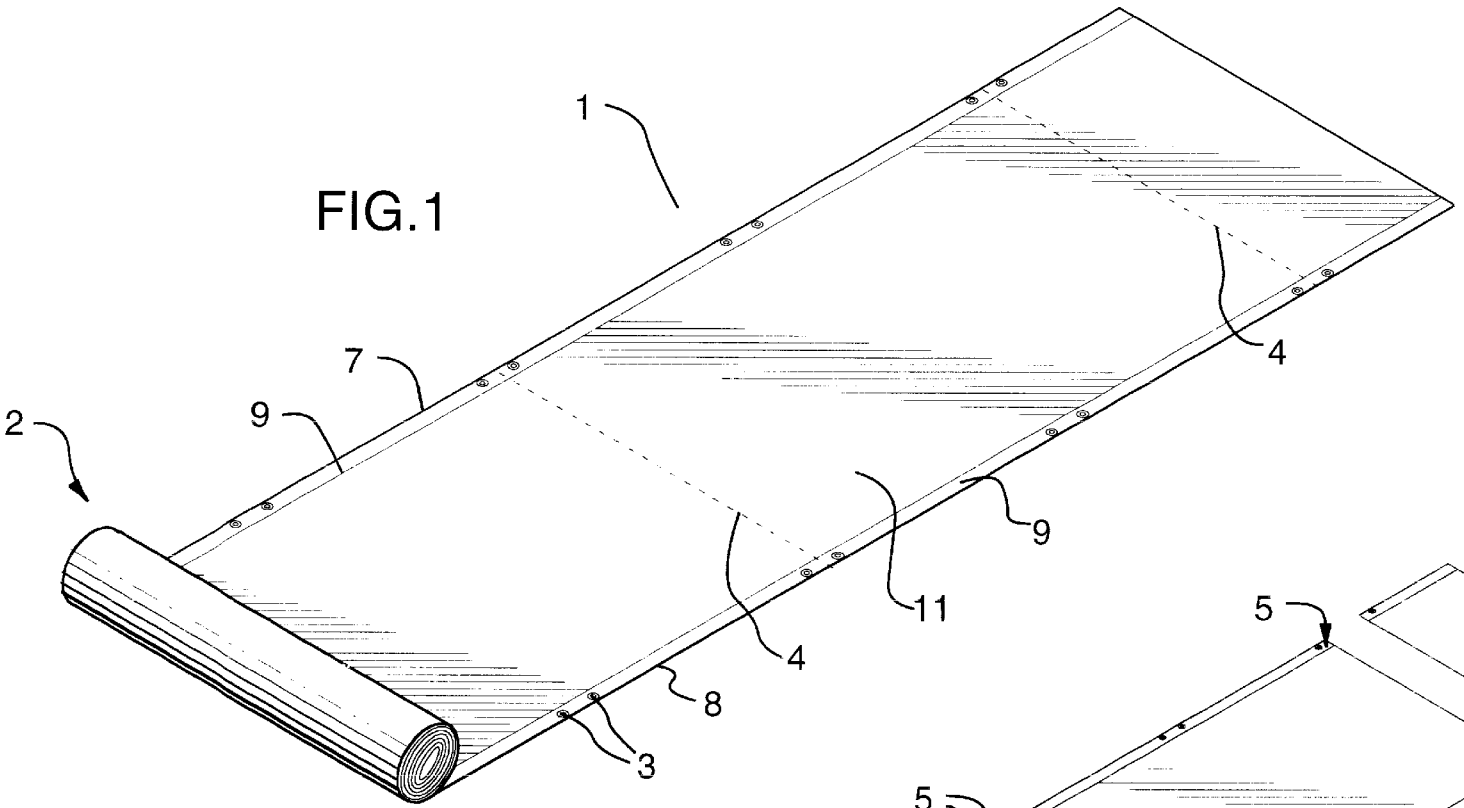
FIG. 1 is a perspective view of the preferred embodiment of the invention.
Figure 2:
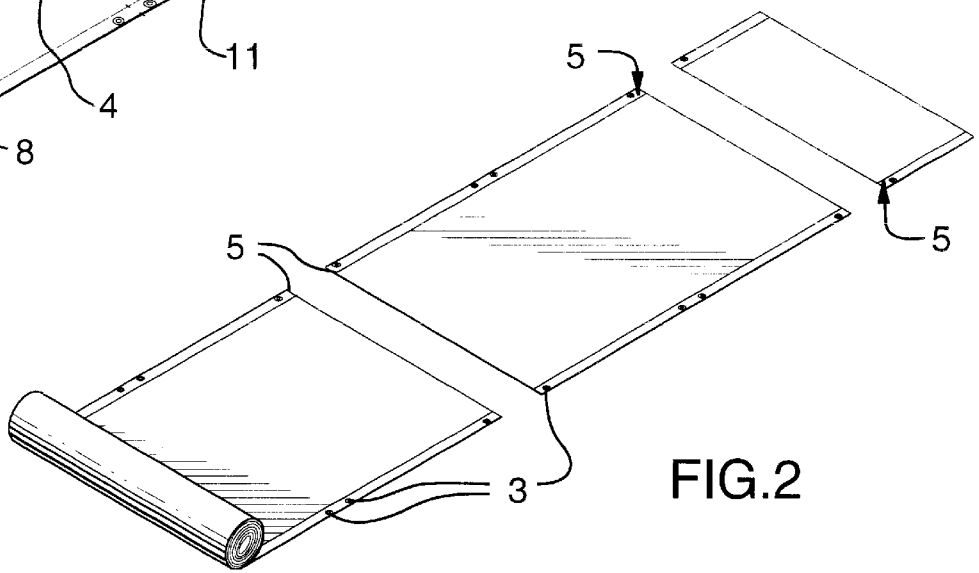
FIG. 2 is a perspective view of the preferred embodiment of the invention with banner material cut at the preferred positions.
Figure 3:
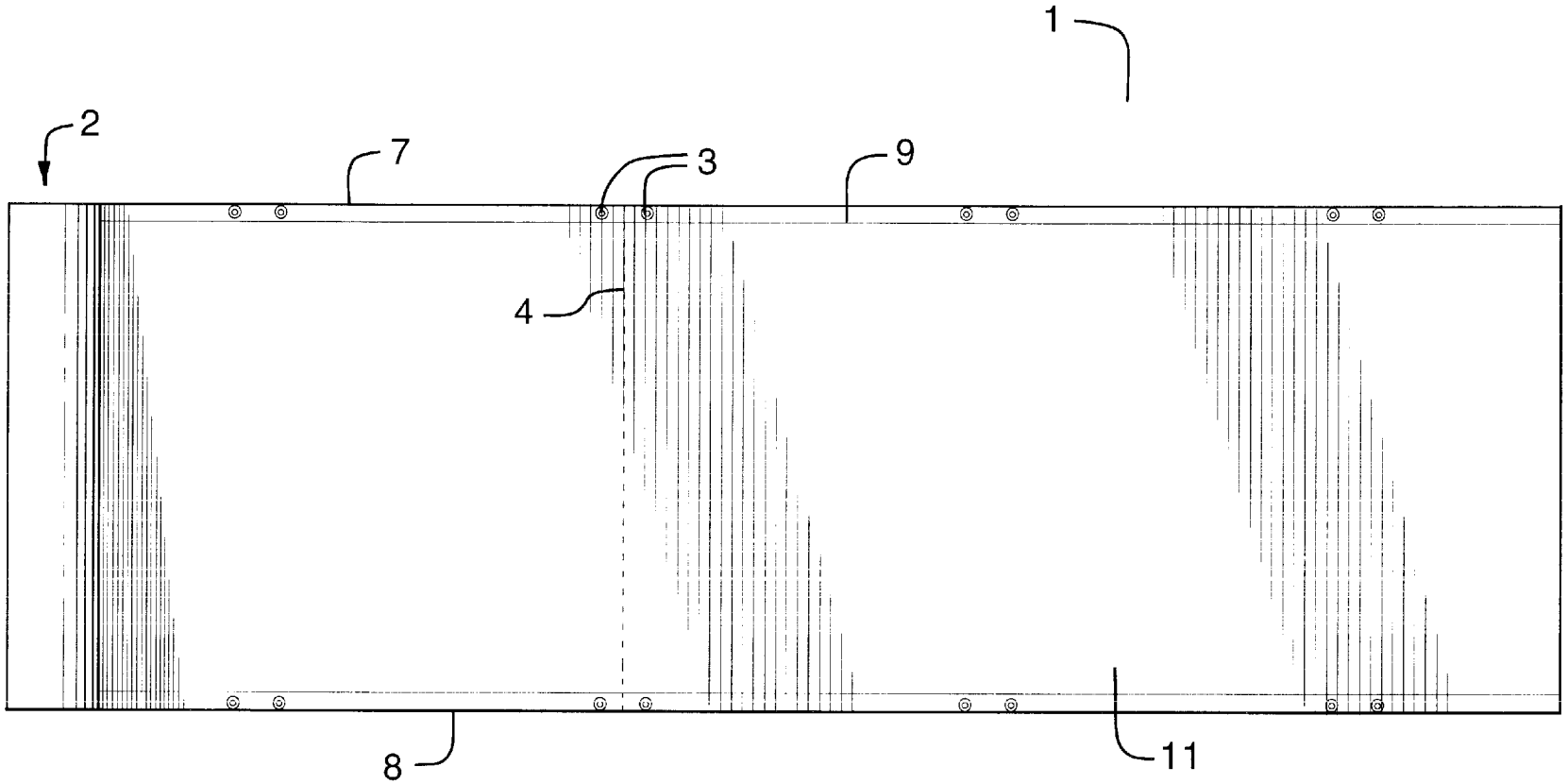
FIG. 3 is a front view of the preferred embodiment of the invention.
Figure 4:
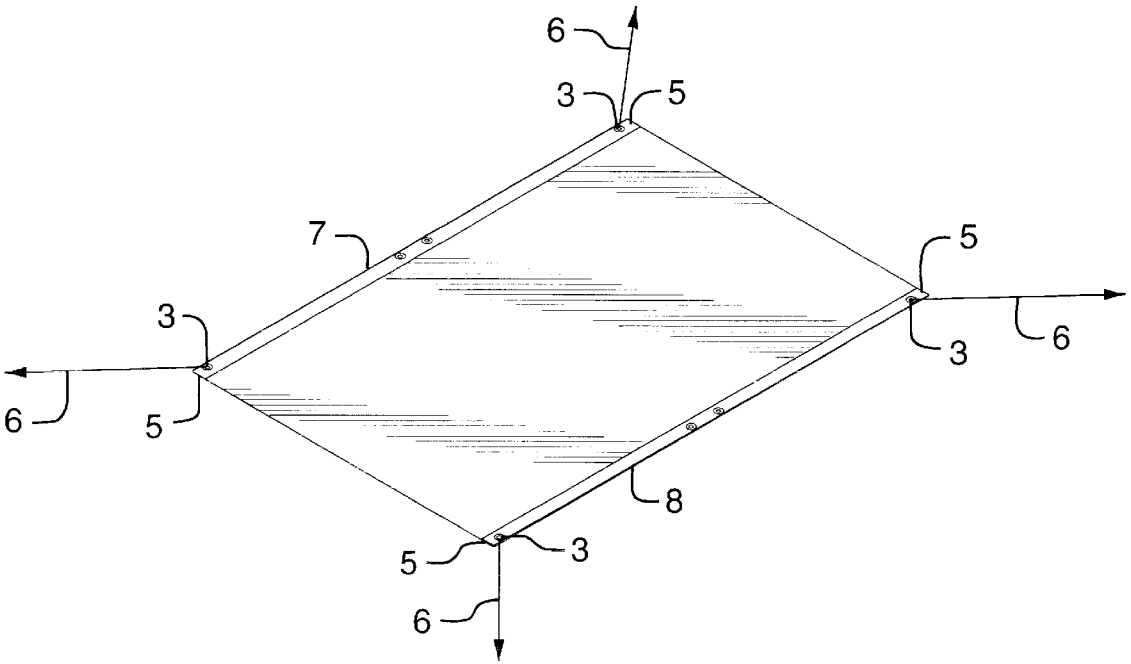
FIG. 4 is a perspective view of a portion of banner material, with cords inserted through grommeted corners.
Figure 5:
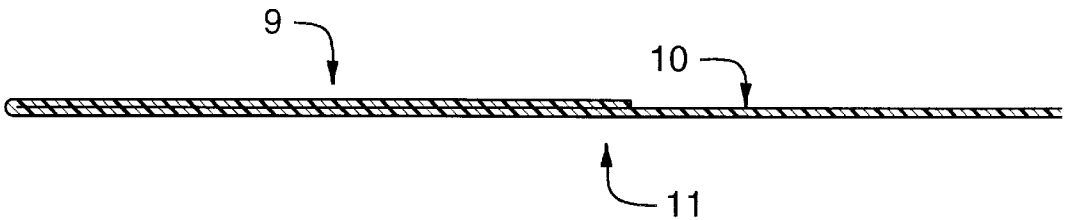
FIG. 5 is a close up cross section view of an edgefold of the banner material.

As summarized above and as shown in FIGS. 1–5 in the preferred embodiment, banner material 1 is comprised of flexible polyester fabric which comes in an elongated sheet, the preferred length of which is 45 feet. Preferably this sheet is stored in a roll 2. A number of grommets 3, are placed along the top edge and bottom edges of the banner material, preferably within the edgefolds. The grommets are spaced along the entire length of the top and bottom edges of the banner material alternately a first distance apart, preferably 24 inches, and then a second substantially smaller distance apart, preferably 3 inches. The grommets along the top edge are aligned with the grommets along the bottom edge. The user of the banner can customize the length of the banner by making a cut 4, perpendicular to the top and bottom edges from top edge to bottom edge between the grommets. Preferably, the user will make this cut from top edge to bottom edge between the grommets spaced the smaller distance apart, creating grommeted banner corners 5, without wasting excess banner material. This will allow the banner to be fixed in place with a cord 6 inserted through each corner grommet. The cords 6 preferably are somewhat elastic so that they can absorb some of the forces caused by wind or other turbulence. The cords are inserted and secured through the grommets placed at each corner of the banner. Each cord is tightened and secured to a fixed position so that the banner can be hung tautly. Placing the grommets in the heat sealed edgefold provides reinforcement and strength to ensure that the grommets will not rip put of the banner material once the cords are tied off and the banner is subject to strong wind forces or other turbulence.

In the preferred embodiment, along the top edge 7 and the bottom edge 8 of the material, a portion of the sheet is folded over to form an edgefold 9. Preferably this portion is folded over onto the back surface 10 of the banner material. In the preferred embodiment, the edgefold portion is heated and pressed together, creating a strong thermal heat sealed bond.

Preferably, the front surface 11 of the banner material is smooth, allowing pressure sensitive vinyl to be adhered to it, so that information messages can be placed on the front surface.

It will be appreciated that the above description relates to the preferred embodiment by way of example only. Many variations on the invention will be obvious to those knowledgeable in the field, and such obvious variations are within the scope of the invention as described and claimed, whether or not expressly described.

For example, the banner may be composed of any flexible material which is sufficiently strong to withstand wind forces or other turbulence, such as canvas or other plastic fiber.

Additionally, the length of the banner roll may be longer or shorter than in the preferred embodiment and the distance as measured from top edge to bottom edge may range from 20 inches to 50 inches. Likewise, the size of the edgefolds along the top and bottom edges may vary.

Additionally, grommets can be spaced along the edgefolds at any various distances and in various numbers. This allows further ability to customize the size of the banner without wasting banner material. These preferred distances may vary. For example, the first distance apart may be as little as 12 inches, which would allow the consumer more ability to customize the exact size of the banner. The first distance may also be greater in order to conserve the number of grommets used. Likewise, the second smaller distance could be as great as 6 inches in order to conserve grommets and as little as 1 inch to minimize wasted banner material, when creating banners by the method discussed above.

What is claimed as the invention is:

1. Banner material for constructing a plurality of banners therefrom, comprising:

an elongated one-piece flexible sheet having a plurality of grommets placed along said sheet adjacent to top and bottom edges thereof, said grommets being spaced along the entire length of said top and bottom edges alternating between a first distance apart and a second closely-spaced distance apart, said first distance being substantially larger than said closely-spaced distance, said sheet being free of grommets through said first distance, said grommets along said top edge being aligned with said grommets along said bottom edge, said banner material being configured to be cut between opposing pairs of said closely-spaced grommets, to thereby form a banner having grommets adjacent each of four corners thereof.

2. Banner material as recited in claim 1, where said first distance apart is at least 12 inches and said closely-spaced distance apart is not greater than 6 inches.

3. Banner material as recited in claim 1, where said first distance apart is approximately 24 inches and said closely-spaced distance apart is approximately 3 inches.

4. Banner material as recited in claim 1, where said flexible sheet is comprised of polyester.

5. Banner material as recited in claim 1, where said sheet is folded over onto itself along top and bottom edges thereof to form edge folds along said top and bottom edges, said grommets passing through said edge folds.

6. Banner material as recited in claim 2, where said flexible sheet is comprised of polyester.

7. Banner material as recited in claim 3, where said flexible sheet is comprised of polyester.

8. Banner material as recited in claim 2, where said sheet is folded over onto itself along top and bottom edges thereof to form edge folds along said top and bottom edges, said grommets passing through said edge folds.

9. Banner material as recited in claim 3, where said sheet is folded over onto itself along top and bottom edges thereof to form edge folds along said top and bottom edges, said grommets passing through said edge folds.

10. Banner material as recited in claim 4, where said sheet is folded over onto itself along top and bottom edges thereof to form edge folds along said top and bottom edges, said grommets passing through said edge folds.

* * * * *